US005641039A

United States Patent [19]

Dumont

[11] Patent Number: 5,641,039

[45] **Date of Patent: *Jun. 24, 1997**

[54] PURCHASE CHECKOUT STATION

[76] Inventor: Charles Dumont, 8925 Collins Ave., Surfside, Fla. 33154

[ * ] Notice: The term of this patent shall not extend beyond the expiration date of Pat. No. 5,437,346.

[21] Appl. No.: 300,333

[22] Filed: Sep. 2, 1994

Related U.S. Application Data

[63] Continuation-in-part of Ser. No. 241,354, May 11, 1994, Pat. No. 5,437,346.

[51] Int. Cl.[6] ..... A47F 9/04

[52] U.S. Cl. ..... 186/61; 186/66

[58] Field of Search ..... 186/61, 66; 235/383

[56] References Cited

U.S. PATENT DOCUMENTS

| | | | |
|---|---|---|---|
| 3,077,950 | 2/1963 | Brown | 186/66 |
| 3,538,311 | 11/1970 | Weidmann | 235/383 |
| 4,084,742 | 4/1978 | Silverman | 235/383 |
| 4,330,048 | 5/1982 | Joseloff | 186/66 |
| 4,676,343 | 6/1987 | Humble et al. | 186/61 |
| 4,766,296 | 8/1988 | Barth | 235/383 |
| 4,909,356 | 3/1990 | Rimondi et al. | 186/61 |
| 4,912,906 | 4/1990 | Toner | 186/66 X |
| 5,013,896 | 5/1991 | Ono et al. | 235/381 |
| 5,047,614 | 9/1991 | Bianco | 235/305 |
| 5,115,888 | 5/1992 | Schneider | 186/61 |
| 5,167,301 | 12/1992 | Cappi et al. | 186/66 |
| 5,174,413 | 12/1992 | Cappi et al. | 186/66 |
| 5,252,814 | 10/1993 | Tooley | 235/383 |
| 5,335,485 | 8/1994 | Cappi et al. | 186/66 X |
| 5,345,071 | 9/1994 | Dumont | 235/383 |
| 5,437,346 | 8/1995 | Dumont | 186/61 |

*Primary Examiner*—F. J. Bartuska
*Attorney, Agent, or Firm*—Oltman, Flynn & Kubler

[57] ABSTRACT

To be used to checkout a plurality of items to be purchased, a purchase checkout station including a product scanner utilized to scan a bar code of the item to be purchased and obtain store and purchase information relative to the item to be purchased, a data transmission connector structured to receive the purchase and pricing information regarding the items to be purchased from the product scanner for transmittal to the purchase checkout station for totalling and storage. The purchase checkout station including a loading platform whereon each item to be purchased is individually placed and verified as an item which has been scanned and whose pricing and purchase information has been transmitted to the checkout station, whereafter the loading platform is moved to an open position enabling the verified item to be purchased atop the loading platform, only if it has been properly scanned, to be placed into an automatically positioned and opened bag which receives a predetermined quantity of the items to be purchased therein and is sealed for secured removal by the consumer subsequent to payment.

23 Claims, 5 Drawing Sheets

PURCHASE CHECKOUT STATION

The present application is a continuation-in-part to the pending application Ser. No. 08/241,354 filed May 11, 1994, now allowed U.S. Pat. No. 5,437,346.

BACKGROUND OF THE INVENTION

1. Field of the Invention

The present invention relates to a purchase checkout station to be utilized to enable consumers at a self-service store to shop independently and quickly, and easily checkout their purchase items themselves while assuring that maximum security is maintained in the stare.

2. Description of the Related Art

Conventional checkout stations inmost self-service stores involve the individual scanning of each product brought to the checkout station by the consumer. Specifically, a consumer will gather all items they desire to purchase, place them on the checkout station on a conveyor or like movable surface where they are presented to a store employee who takes each item selected by the consumer and scans its bar code. After scanning, the store employee then places the object on a ramp or second conveyor where it moves to a bagging area for manual bagging by the cashier, another store employee or the consumer. While these procedures are substantially improved over what was previously necessitated, namely the numeric entry of the price of each item by the store employee, this conventional type of checkout can still be quite time-consuming. Accordingly, there is a need for an improved checkout station which can substantially increase checkout efficiency by allowing a consumer to scan items themselves, either through a portable hand held scanner or at the checkout station, and by providing immediate automatic bagging of scanned items, while ensuring efficient checkout and store security.

The checkout station of the present invention is adapted specifically to allow for the increased consumer independence, and to eliminate limits on checkout volume which relate to the need for having at least one store employee at each checkout station, and thus overcomes many of the problems associated with the related art.

SUMMARY OF THE INVENTION

The present invention is directed towards a purchase checkout station. The checkout station includes product scanning means which are structured and disposed to scan a bar code of an item to be purchased, by an individual consumer shopping within a self-service store, and obtain pricing and purchase information relative to the item to be purchased. Disposed in information receiving and transmitting communication with said product scanning means is a data input connection. In particular, the data input connection will receive pricing and purchase information relative to the items to be purchased from the product scanning means and direct the information to data processing means of the purchase checkout station wherein the pricing and purchase information of all of the items to be purchased are stored and totaled. To enable a consumer to see the pricing and purchase information of all of the items to be purchased and scanned by them, display means are included with the purchase checkout station. The display means will display pricing totals and purchase information for convenient access and verification by a consumer.

Preferably centrally disposed on the checkout station is a primary support surface having a loading platform movably disposed thereon. The loading platform is adapted to receive each of the items to be purchased individually thereon. While on the loading platform, each of the items to be purchased is checked by verification means which ensure that the item to be purchased which has been placed on the loading platform is scanned by the product scanning means to identify and transmit the purchase and pricing information relative to the item to be purchased to the data processing means. Once appropriate scanning is verified, bagging means position an empty bag in an open position such that the bag will receive the item to be purchased, and only that item, therein from the loading platform. Further, only upon positive verification of the item to be purchased by the verification means will the item to be purchased be slid into the open bag. A number of the verified items are put into the bag, until a predetermined quantity of the items to be purchased have been disposed within the bag and a new bag must be utilized and automatically dispensed into the open, receiving position. At that point the filled bag is sealed and moved to a convenient dispensing position for retrieval by the consumer.

It is an object of the present invention to provide an improved purchase checkout station for use directly by a consumer so as to checkout purchase items such as groceries without the need for a store attendant.

Another object of the present invention is to provide a purchase checkout station which enables a consumer to independently scan the bar codes of items to be purchased for rapid, self-service checkout.

Still another object of the present invention is to provide a purchase checkout station which a consumer can individually use with a purchase monitoring device that scans bar codes of items to be purchased.

Yet another object of the present invention is to provide a purchase checkout station which does not require a store employee to operate, yet which will ensure that security precautions are maintained and that only verified, scanned items will be bagged or removed from the store.

A further object of the present invention is to provide a purchase checkout station which will automatically bag items to be purchased.

An additional object of the present invention is to provide a checkout station which is substantially small and compact, thereby enabling a large number of the checkout stations to be disposed throughout a self-service store.

Another object of the present invention is to provide a checkout station whose use is not limited to the availability of a store employee to expressly operate the station.

BRIEF DESCRIPTION OF THE DRAWINGS

For a fuller understanding of the nature of the present invention, reference should be had to the following detailed description taken in connection with the accompanying drawing in which.

Like reference numerals refer to like parts throughout the several views of the drawings.

DETAILED DESCRIPTION OF THE PREFERRED EMBODIMENT

Figure 1:
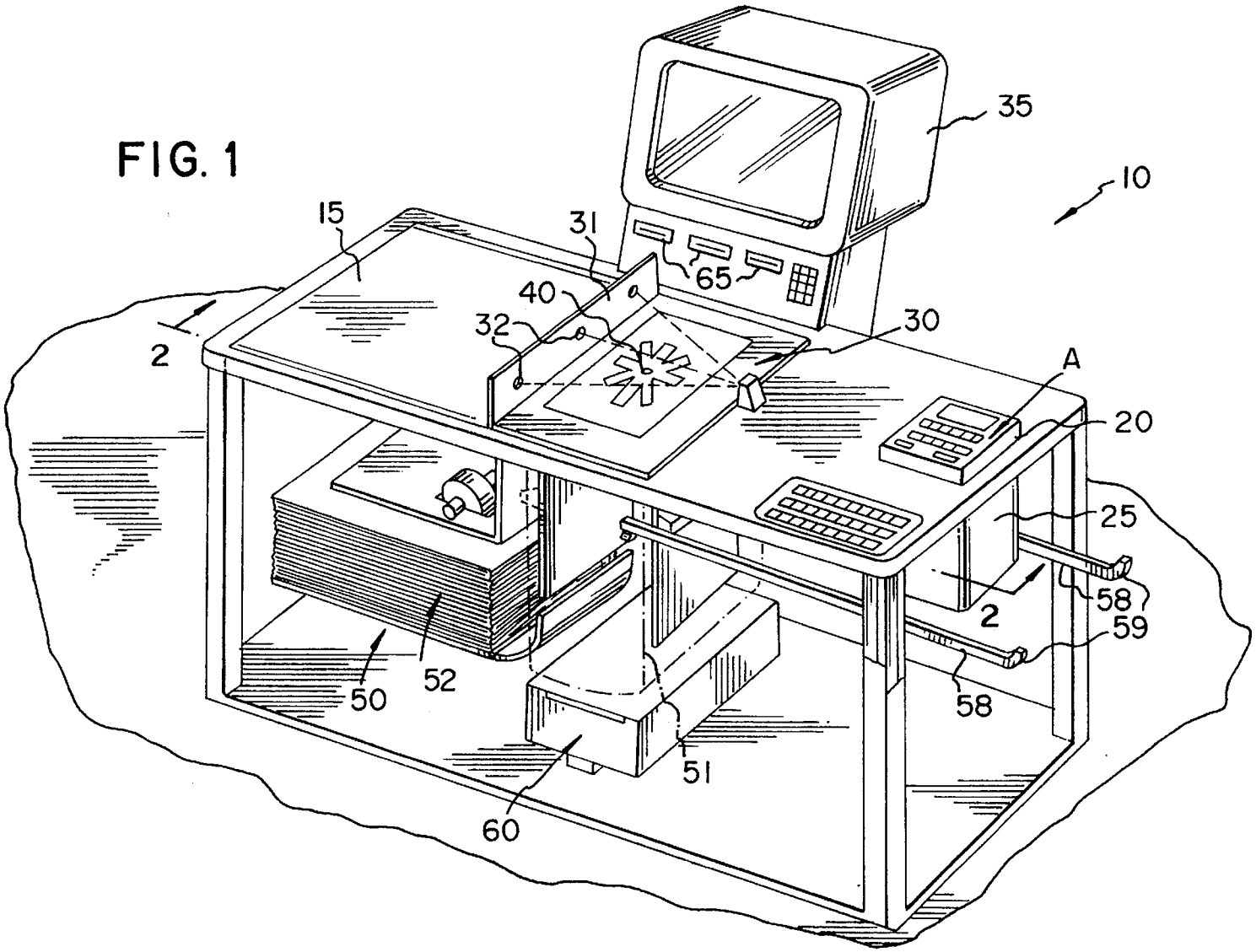
FIG.1 is a front perspective view of a first embodiment of the checkout station of the present invention.
Figure 2:
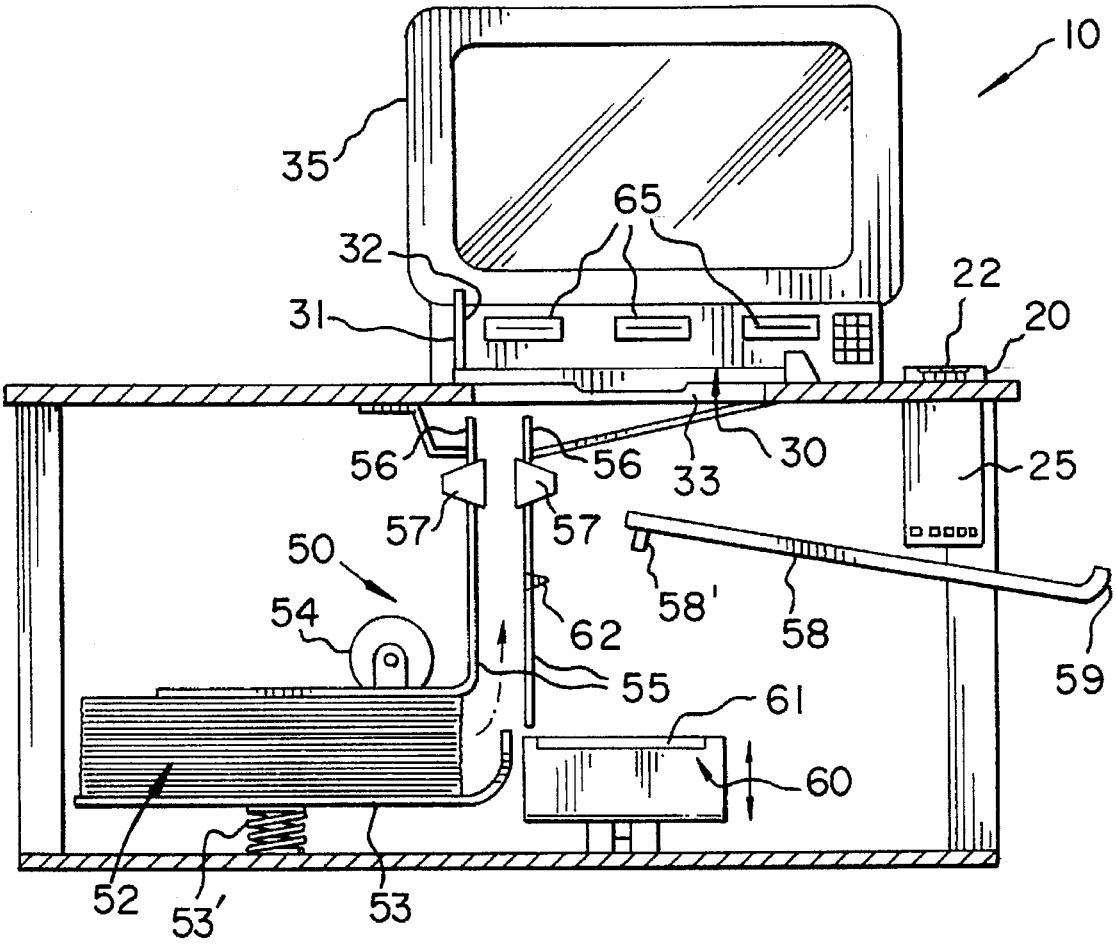
FIG. 2 is a side cross-sectional view along line Z—Z of FIG. 1 illustrating a bag dispensing position.
Figure 3:
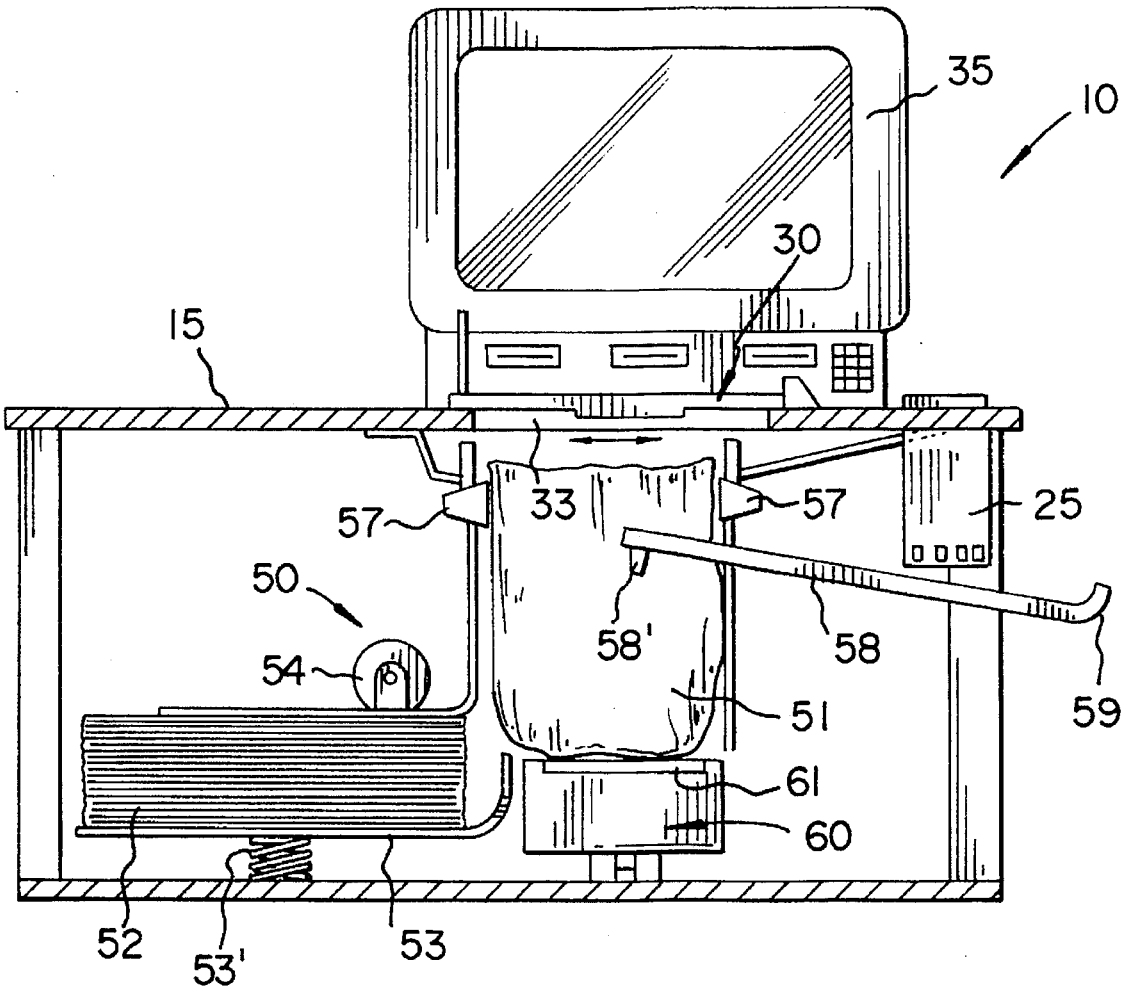
FIG. 3 is a side cross-sectional view along line Z—Z of FIG. 1 illustrating an item receiving position.
Figure 4:
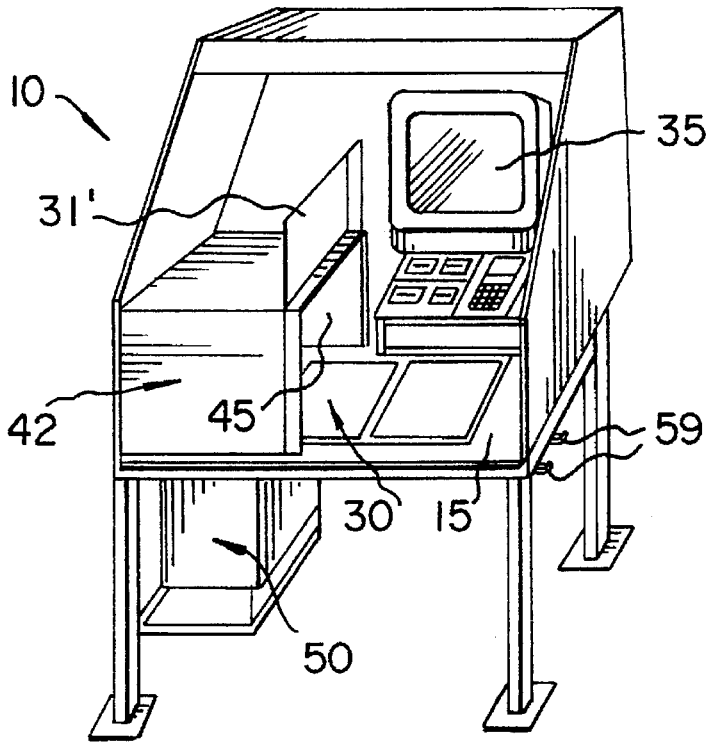
FIG. 4 is a front perspective view of another embodiment of the checkout station of the present invention.
Figure 5:
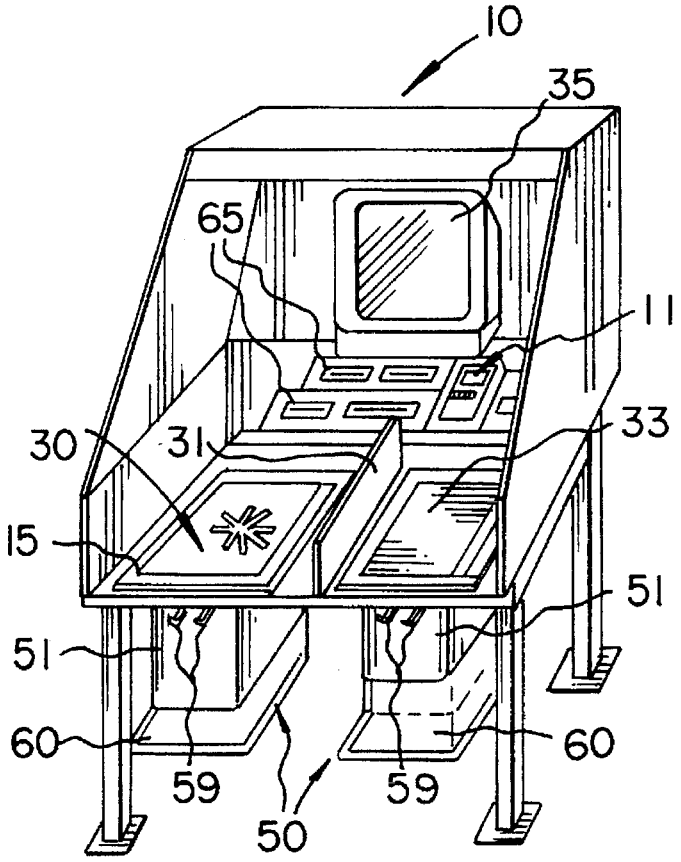
FIG. 5 is a front perspective view of yet another embodiment of the checkout station of the present invention.
Figure 6:
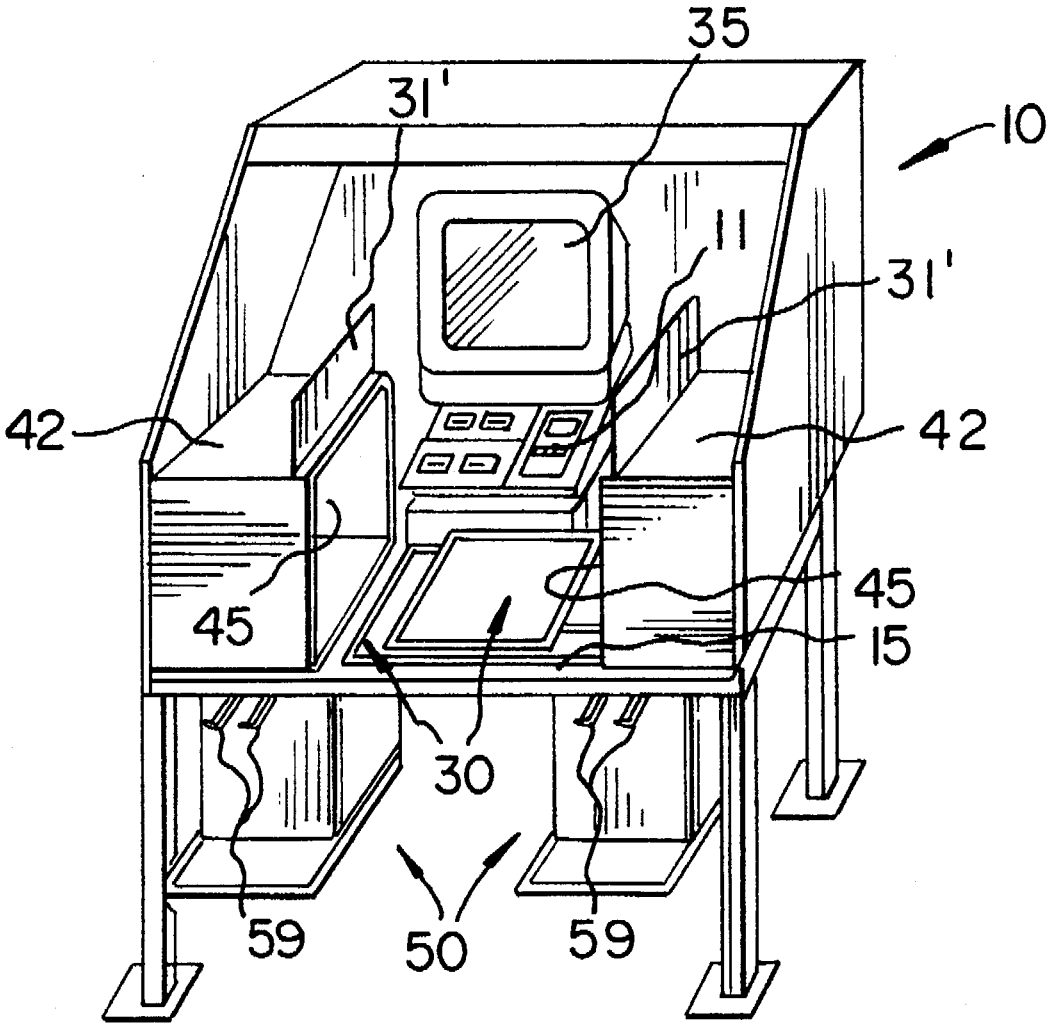
FIG. 6 is a front perspective view of still another embodiment of the checkout station of the present invention.

Shown in the Figures, the present invention is directed towards a checkout station generally indicated as 10. The checkout station 10 includes product scanning means 11 to allow a consumer to independently scan the bar code of items to be purchased. In a preferred embodiment, the product scanning means 11 will be in the form of a bar code product scanner formed as part of, and directly connected to the checkout station. In an alternative embodiment the product scanning means 11 can be in the form of a separate scanning device such as a purchase monitoring device A which scans the bar code of individual items to be purchased and designates the scanned items as purchase items. The particular construction of the illustrated purchase monitoring device A, although not particularly germane to the present invention, can be shown as described in detail in the previously filed, now allowed U.S. patent application, Ser. No. 08/036,970, and filed on Mar. 25, 1993, now U.S. Pat. No. 5,345,071 the disclosure of which is incorporated herein by reference.

The checkout station 10 includes preferably a substantially, small compact primary support surface 15 such that the checkout station 10 will not take up excessive space and can be conveniently disposed throughout a self-service store such as a grocery store. In the alternative embodiment which utilizes a portable purchase monitoring device A, a monitor cradle 20 is formed within the support surface 15. The monitor cradle 20 is sized to correspond the dimensions of the purchase monitoring device A so as to receive and hold the purchase monitoring device A snugly therein during checkout.

Disposed in information receiving and transmitting connection with the product scanning means is a data input connection. In the case of the product scanning means 11 connected directly to the checkout station 10, the wiring connections between the product scanning means 11 and the checkout station 10 function as the data input connection. When using the portable purchase monitor A, the data input connection 22 is included within the recess of the monitor cradle 20. This data input connection 22 is preferably in the form of a toothed electrical contact and is positioned within the monitor cradle 20 so as to be in information receiving and transmitting communication with a data transmission connector of the purchase monitoring device A disposed within the monitor cradle 20. Accordingly, the data input connector 22 can receive pricing and purchase information relative to the items to be purchased from the purchase monitoring device A. In particular, the purchase monitoring device A scans the bar code of individual items sought to be purchased by a consumer and stores pricing and purchase information regarding the items therein so as to keep a running total of the cost of the items to be purchased by the consumer. Upon connection of the purchase monitoring device A within the monitor cradle 20, the purchase and pricing information regarding only the items which have been scanned by the consumer as purchase items and accordingly preferably designated as purchase items by the purchase monitoring device A are inputted into the checkout station through the data input connection 22.

From the data input connection, information is transmitted to data processing means within the checkout station 10 which store and total the pricing and purchase information of all of the items to be purchased. Further, conveniently disposed atop the checkout station 10 are display means preferably in the form of a display monitor 35. This display monitor 35 will display the pricing and purchase information regarding each of the items to be purchased and the pricing total regarding all of the items to be purchased conveniently to the user. Specifically, a running total of each item as it is placed on the checkout station 11 can be maintained, and when using the portable purchase monitor A, a correlating checklist where each item be purchased, as it placed on the checkout station 10, is referenced and checked off the total list of item to be purchased as scanned by the purchase monitoring device A and transmitted to the checkout station 10, can also be maintained.

In order to assist the expedited and efficient scanning and automatic bagging process, the checkout station 10 is preferably equipped with a display indicating the preferred scanning/bagging order of items. When using the purchase monitor device A, since all items have already been scanned, a specific indication as to a preferred packaging order of items can be displayed to facilitate bagging. Additionally, other informational or advertising materials can be displayed on the display monitor 35.

When checking out, a consumer who goes to the checkout station 10 will insert the purchase monitoring device A into the monitor cradle 20, if one is being used, and will place each item to be purchased individually on the primary support surface 15, one item at a time. In particular, the support surface 15 includes a centralized loading platform 30 whereon each item to be purchased is individually placed, or placed with a plurality of like items such as a number of equally sized and priced packages of a particular product. Preferably, this loading platform 30 will be in the form of a single panel which is slidably mounted on the primary support surface 15. This loading platform 30 will be moveable between an open position and a closed position, the open position allowing access beneath the loading platform 30 through an access opening 33 formed in the primary support surface 15. Additionally, a stopper panel 31 is positioned above the loading platform 30. The stopper panel 31 is positioned such that the loading platform 30 will slide thereunder when moving from its normally closed position to the open position. Accordingly, as the loading platform 30 slides, the item to be purchased placed on the loading platform 30 will contact the stopper panel 31 and slide off of the loading platform 30 and through the access opening 33. Alternatively, the loading platform 30 can include the single panel or a pair of abutting panels which are slidingly disposed in the support surface 15 or are hingedly secured to the support surface 15 such that they pivotally slope downward upon movement from the closed position to the open position, thereby sliding the item to be purchased downwardly.

In a preferred embodiment, and in order to expedite the checkout procedures, the primary support surface 15 includes a pair of spaced access openings 33 through which items to be purchased can slide. In this embodiment, the loading platform 30 alternately moves from covering relation over a first one of the access openings 33, to covering relation over a second of the access openings 33. Accordingly, when a consumer places one item on the loading platform 30, the loading platform 30 slides beneath the stopper panel 31, which separates both access openings 33, causing the item on the loading platform 30 to slide off and through the access opening 33 while the loading platform 30 slides into closing position above the second access opening in order to receive the next item to be purchased thereon. Additionally, two of the loading platforms 30 can be included, one adapted to slide over another. Specifically, there is a central zone on the primary support surface 15 between the access openings 33, each loading platform 30 sliding onto the central zone in order to reveal the respective access openings 33. When both loading platforms 30 are disposed on the central zone, one of the loading platforms 30 Will necessarily be slidingly disposed atop the other.

Initially, when the loading platform 30 is in its closed position above one of the access openings 33, an individual item to be purchased is disposed thereon where it scanned or is merely checked by verification means 40. When using a product scanning means 11 which is connected with the checkout station 10, the scanning means 11 can includes a hand held scanner, a scanner built into the surface of the loading platform 30, or multi directional scanner structured to scan the item to be purchased no matter what orientation it has on the loading platform 30.

The verification means 40, which can also be multi-directional or be vertically positioned on the checkout station 10, is preferably positioned within the surface of the loading platform 30. In any event, the verification means 48 must be positioned in a location where it can check the area on the loading platform 30 and ensure that the item to be purchased which has been placed atop the loading platform 30 has in fact been scanned so as to transmit the purchase and pricing information relative to the item to be purchased to the check out station 10. When using the portable purchase monitor A, the verification means 40 verifies that the pricing and purchase information relative to the item on the loading platform 30 has been transmitted from the purchase monitoring device A to the data processing means of the checkout station 10. Preferably, the verification means 40 will correspond purchase designation means of the purchase monitoring device A. Specifically, the purchase monitoring device A, upon scanning an item as a purchase item, will designate that item as a purchase item. This designation can be in the form of visible ink marks on the item to be purchased, magnetic encoding on the item to be purchased, or any other suitable marking means. In such a case, the verification means 40 will preferably be in the form of a reader adapted to check for the presence of the appropriate designation as marked by the purchase monitoring device A, such that only upon the verification of the appropriate purchase designation will the loading platform 30 be allowed to move to its open position allowing the item to be purchased to slide there beneath. Alternatively, the verification means 40 can be in the form of a bar code scanner which functions as the product scanning means 11 and will scan the item to be purchased prior to permitting movement of the loading platform 30.

Once the item to be purchased on the loading platform 30 has been properly identified and scanned, the loading platform 30 will move to its open position such that only the single item verified on the loading platform 30 falls there beneath and into an open, empty bag 51 disposed preferably directly under the access opening 33 beneath the loading platform 30. Assurance that only one item was on the verification platform 30 can be achieved either before bagging an item through the verification means 40 which can be structured to check for multiple items or the replacement of an item on the loading platform 30 subsequent to its verification, or alternatively, can be achieved by checking the items as they enter the bag 51, as will be discussed subsequently. Further, the stopper panel 31 can include a number of photocells 32 therein which enshroud the area over the loading platform 30 after an item has been placed on the loading platform 30, thereby detecting if an additional item is placed or substituted on the platform 30 after verification and during movement of the loading platform 30. Such a photocell system could also detect a persons hand reaching into the access opening 33 beneath the platform 30 and cause a security panel to slide into place or otherwise necessitate re-scanning of an item.

In a preferred embodiment, the checkout station 10 will also include a security area 42 disposed on the primary support surface 15 to cover each of the access openings 33. Preferably, the security area 42 will include a top wall and a plurality of side walls to enable accede to the interior of the security area 42 only through a specific open side 45, and can be separately formed atop the primary support surface 15, or formed as part of the checkout station 10 as a whole as is utilized in various ATM machines with numerous compartments. Additionally, the open side 45 is preferably structured with closure means such as a closing panel 31', and sensors to detect entry or exit through the open side 45. In one embodiment, the stopper panel 31 functions as the closing panel 31' such that the loading platform 30 must slide thereunder to reveal the access opening 33. In use, a consumer places the item to be purchased on the loading platform 30 outside of the security area 42. Next, either through a push button or sensors within the loading platform 30, the loading platform 30 moves into the security area. During the loading platforms 30 movement into the security area 42, the bag 51 is maintained in a closed position beneath the access opening 33 so as to prevent any item from being disposed in the bag 51 when the closing panel 31' is not covering the open side 45 of the security area. Once the loading platform 30 is within the security area 42, the open side is closed by the closing panel 31' and any items within the security area 42 are scanned or., verified. Finally, after scanning the loading platform 30 moves out of the security area 42 to reveal the access opening 33 and load the item into the bag 51 which is positioned in an open position. Sensors will detect any substitution of items or addition of items through the open side 45 of the security area 42 when open, and the closing panel 31' will seal off the open side 45 allowing the loading platform 30 to slide thereunder. Accordingly, there is added security that only a properly scanned and verified item to be purchased will be packed into a grocery bag 51.

Once an item is appropriately verified, the loading platform 30 will move to its open position and the item to be purchased will slide into the bag 51 disposed beneath the loading platform 30. The bag 51, which is preferably a plastic grocery type bag is disposed in its open position by bagging means 50 which are structured and move the empty bag 51 to an open position beneath the loading platform 30 where it will receive a number of the items to be purchased therein until a predetermined, maximum quantity of items to be purchased have been disposed within the bag 51. In the case of two access openings, two of the bagging means so will be disposed side by side so as to provide automatic bagging at each access. Preferably, the bagging means 50 include a bag reserve 52 wherein a plurality of empty bags are disposed awaiting use. These reserve bags 52 can be positioned on tracks which run along the length or width of the platform 15 or stacked within a bag bin 53 which uses a spring 53' to upwardly urge the stack of bags into dispensing position. Upon the bag 51 being filled and removed from beneath the loading platform 30, automatic dispensing means of the bagging means 50 draws a new bag from the bag reserve into position beneath the loading platform 30 in the open position such that further items to be purchased can be received for bagging. Although the bag dispensing means can be structured in a variety of ways, such as utilizing hooks, adhesives and the like to pull a bag to the open position and/or beneath the platform 15, the preferred automatic dispensing means will include a number of rollers 54 which pull a single bag from the bag reserve 52 up through a guide track 55 where suction members 56 adhere to a top edge of each side of the bag 51 moving the bag beneath the loading platform 30 and opening and closing the bag 51 as necessary. In particular, the bag Will be closed to prevent access thereto when the security area 42 is open.

In order to ensure that the items do not fall too abruptly into the bag 51, load shock absorption means preferably in the form of a movable, cushioned platform 60 are disposed beneath the open bag 51. This movable platform 60, which begins in an elevated position near a top of the bag 51, is disposed along a bottom of the bag 51 such that upon the first of the items to be purchased sliding beneath the loading platform 30 into the bag 51, the item will have to slide only a short distance to the bottom of the bag 51. Subsequently, and upon a greater quantity of items being inserted into the bag 51, the platform 60 will gradually lower until finally the predetermined quantity of items to be purchased have been positioned within the grocery bag 51. This platform 60 can lower either through the weight of item in the bag 51 or through sensors which determine the entry of an item into the bag 51, and can utilize scissor members, a hydraulic lift member, or any other suitable means to provide the necessary supporting elevation.

To detect when the predetermined quantity of verified items to be purchased has been positioned within one of the bags 51, the bagging means 50 includes bag load checking means. Preferably, these bag load checking means are in the form of a scale 61 disposed within the movable platform 60-The scale 61 can be used to measure the weight of items within the bag so as to compare it to a maximum weight capacity of the bag which corresponds the predetermined quantity of verified items to be purchased which can be positioned in the bag 51. Additionally, or alternatively, the bag load checking means can be in the form of an optic fill height meter 62 which emits a sensor through a preferably transparent bag 51 so as to measure a height of items in the bag 51 and detect when a maximum height capacity of the bag 51, which corresponds the predetermined quantity of verified items to be purchased which can be disposed within the bag 51, is reached.

In addition to functioning as load checking means, the scale 61 can also function to provide additional safety and ensure that only the appropriate item is inserted into the bag 51. This is accomplished by using the scale 60 to detect incremental weight increases of items disposed within the bag 51. Specifically, utilizing the scale 61, if the weight increase of weight into the bag 51 does not correspond the weight of the item to be purchased as verified utilizing the verification means 40 and scanned by the purchase monitoring device A, an indication that an illegal substitution has been made can be provided.

Once the bag load checking means have indicated that the particular bag 51 beneath the loading platform 30 is full, bag sealing means are preferably utilized to close the grocery bag 51. These bag sealing means are preferably in the form of heat panels 57 which sandwich an upper portion of the grocery bag 51, preferably beneath the suction members or other means whereby the bag is supportably held in the open position, therebetween to provide a heat seal at the top of the grocery bag 51. Alternative sealing means, however, such as adhesives, staples, clips or like means known in the art could also be utilized. In the case of the sealing means, it is important that once the bag 51 has been sufficiently filled, the bag 51 is sealed in such a manner that if opened, it will be noticeable. This seal serves as an added security measure to ensure that a 21 consumer does not insert items which have not been scanned or paid for into the bag 51 subsequent to checkout. Also, the sealing means can also serve to cut the bag and release it from its held position beneath the loading platform. Specifically, each bag 51, upon movement to the open position beneath the loading platform 30 by the automatic dispensing means, will either through its own handle openings or other holding means 58' such as hooks, clips, graspers, or any like holding means known in the art, engage and be held on a pair of elongate, downwardly sloped tracks 58 which run along a length or width of the platform. Accordingly, once the bag 51 has been filled and sealed, removal means of the bagging means will move the filled bag along the tracks 58 which terminate in a pair of receptacle handles 59 where the bag 51 is conveniently disposed for gathering by the user. At that point a new bag will be drawn from the bag reserve 52 and positioned beneath the loading platform 30 in its open position.

Also included on the checkout station 10 are payment means 65. These payment means 65 can be in the form of a normal ATM card receiver wherein a user enters an ATM card and using a numeric key pad enters a secret code, and/or can include a cash receiver which can receive bills of certain denominations and otherwise provide change to a user. It is also contemplated that a form of check reader and receiver can be incorporated to allow payment by checks.

As added security, and in order to maintain control over the purchase monitoring devices A dispensed within the store, if utilized, the monitor cradle 20 includes a monitor receptacle 25 there beneath which can store a quantity of the purchase monitoring devices A subsequent to their use and positioning within the monitor cradle 20. Specifically, the monitor cradle 20 can include a hinged bottom wherein subsequent to transmission of the pertinent purchase and pricing information from the purchase monitoring device A to the checkout station 10, the hinged bottom of the monitor cradle 20 will open allowing the portable purchase monitoring device A to drop beneath the monitor cradle 20 and into the monitor receptacle 25.

The specific mechanisms as described herein illustrate merely the preferred embodiment of the checkout station at the time of application. It is contemplated that variations consistent with the claimed invention fall within the scope of the claims as written and contemplated by the doctrine of equivalents.

Now that the invention has been described,

What is claimed is:

1. To be used to checkout an item to be purchased, a purchase checkout station comprising:

product scanning means structured and disposed to scan a bar code of the item to be purchased and obtain pricing and purchase information relative to the item to be purchased, p1 a data input connection disposed in information receiving and transmitting communication with said product scanning means, said data input connection structured and disposed to receive the pricing and purchase information relative to the items to be purchased from said product scanning means, data processing means structured and disposed to store and total the pricing and purchase information of all of the items to be purchased, display means structured and disposed to display the pricing and purchase information regarding the items to be purchased and the pricing totals regarding all of the items to be purchased to a user, a primary support surface, a loading platform movably disposed on said primary support surface and structured to receive each of the items to be purchased individually thereon, automatic bagging means structured and disposed to position an empty bag in an open position such that it will receive the item to be purchased on said loading platform therein only if said item to be purchased has been properly scanned by said product scanning means, said automatic bagging means being further structured to enable only a predetermined quantity of said items to be purchased to be disposed in said bag, wherein said primary support surface includes an access opening, said access opening being structured and disposed to overlie said bag of said automatic bagging means and allow access thereto by said items to be purchased, wherein said loading platform is disposed above said access opening such that upon movement of said loading platform out of covering relation above said access opening, said item to be purchased on said loading platform will fall off said loading platform into said bag beneath said access opening, and wherein said loading platform has an upper face and wherein said product scanning means is mounted in said loading platform upper face such that placing said item to be purchased onto said loading platform both causes said item to be scanned and positions said item to fall from said loading platform into said bag upon said movement of said loading platform.

2. A purchase checkout station as recited in claim 1 wherein said automatic bagging means includes bag sealing means structured and disposed to seal the bag in a closed position subsequent to said predetermined quantity of said items to be purchased being positioned in the bag.

3. A purchase checkout station as recited in claim 2 including two of said automatic bagging means disposed to alternately receive said items to be purchased from said loading platform until said predetermined quantity of said items to be purchased is disposed in the bag of each of said automatic bagging means.

4. A purchase checkout station as recited in claim 3 wherein, said primary support surface includes a pair of spaced access openings, each of said access openings being structured and disposed to overly said bag of each of said automatic bagging means and allow access thereto by said items to be purchased.

5. A purchase checkout station as recited in claim 3 wherein each of said automatic bagging means includes:

a bag reserve structured and disposed to contain a plurality of empty bags, automatic dispensing means structured to position one of said empty bags from the bag reserve to said open, item receiving position beneath said primary support surface, and removal means structured and disposed to move a full one of the bags from beneath said loading platform to a dispensing position.

6. A purchase checkout station as recited in claim 2 including bag load checking means structured and disposed to detect when said predetermined quantity of items to be purchased have been positioned in one of the bags and direct said bag sealing means to seal the bag.

7. A purchase checkout station as recited in claim 6 wherein said bag load checking means includes a scale disposed beneath the bag under said loading platform, said scale measuring a weight of items in the bag and detecting when a maximum weight capacity of the bag, which corresponds said predetermined quantity of items to be purchased, is reached.

8. A purchase checkout station as recited in claim 6 wherein said bag load checking means includes an optic fill height meter structured and disposed to measure a height of items in the bag and detect when a maximum height capacity of the bag, which corresponds said predetermined quantity of items to be purchased, is reached.

9. A purchase checkout station as recited in claim 6 including load shock absorption means structured and disposed to cushion positioning of said items to be purchased in the bag.

10. A purchase checkout station as recited in claim 9 wherein said load shock absorption means includes a cushioned, vertically moveable platform which is elevated to lift a bottom of the bag upward towards said leading platform, and gradually lower as said items to be purchased are slidingly positioned into said bag from said loading platform.

11. A purchase checkout station as recited in claim 1 further including payment receiving means structured and disposed to receive an appropriate payment corresponding the totaled cost of all of the items to be purchased as scanned by said product scanning means and transmitted to the data processing means.

12. A purchase checkout station as recited in claim 1 wherein said product scanning means includes a portable purchase monitoring device which is utilized to scan the bar code of the item to be purchased and obtain and store pricing and purchase information relative to the item to be purchased.

13. A purchase checkout station as recited in claim 12 wherein said primary support surface includes a monitor cradle structured and disposed to receive and hold the purchase monitoring device, and said monitor cradle including said data input connection disposed in information receiving and transmitting communication with a data transmission connector of the purchase monitoring device.

14. A purchase checkout station as recited in claim 13 including a monitor receptacle beneath said monitor cradle, said monitor receptacle being, structured to automatically and securely receive the purchase monitoring device therein subsequent to transmission of the pricing and purchase information relative to the items to be purchased from the purchase monitoring device to said data processing means.

15. A purchase checkout station as recited in claim 1 further including verification means structured and disposed to verify that the item to be purchased placed on said loading platform has been scanned by said product scanning means so as to transmit the purchase and pricing information relative to the item to be purchased to said data processing means.

16. A purchase checkout station as recited in claim 15 wherein said verification means are disposed in said loading platform.

17. A purchase checkout station as recited in claim 1 including a security area disposed on said primary support surface and being structured and disposed to substantially cover said loading platform, upon its receiving said item to be purchased thereon and sliding into said security area, so as to detect and prevent entry into said security area subsequent to said loading platform with said item to be purchased thereon entering said security area for transfer of said item to be purchased to said automatic bagging means, and thereby ensuring that only properly scanned ones of said items to be purchased are loaded into said bag of said automatic bagging means at one time.

18. A purchase checkout station as recited in claim 1 wherein said loading platform is structured to receive a plurality of like ones of said items to be purchased at one time.

19. To be used to checkout an item to be purchased, a purchase checkout station comprising:

product scanning means structured and disposed to scan a bar code of the item to be purchased and obtain pricing and purchase information relative to the item to be purchased, a data input connection disposed in information receiving and transmitting communication with said product scanning means, said data input connection structured and disposed to receive the pricing and purchase information relative to the items to be purchased from said product scanning means, data processing means structured and disposed to store and total the pricing and purchase information of all of the items to be purchased, display means structured and disposed to display the pricing and purchase information regarding the items to be purchased and the pricing totals regarding all of the items to be purchased to a user, a primary support surface, a loading platform movably disposed on said primary support surface and structured to receive each of the items to be purchased individually thereon, automatic bagging means structured and disposed to position an empty bag in an open position such that it will receive the item to be purchased on said loading platform therein only if said item to be purchased has been properly scanned by said product scanning means, said automatic bagging means being further structured to enable only a predetermined quantity of said items to be purchased to be disposed in said bag, wherein two of said automatic bagging means are disposed to alternately receive said items to be purchased from said loading platform until said predetermined quantity of said items to be purchased is disposed in the bag of each of said automatic bagging means, wherein said automatic bagging means includes bag sealing means structured and disposed to seal the bag in a closed position subsequent to said predetermined quantity of said items to be purchased being positioned in the bag, wherein said primary support surface includes a pair of spaced access openings, each of said access openings being structured and disposed to overlie said bag of each of said automatic bagging means and allow access thereto by said items to be purchased, a stopper panel structured and disposed to push said items to be purchased from said loading platform through one of said access openings into one of said bags.

20. A purchase checkout station as recited in claim 19 wherein said loading platform is slidingly disposed above said access openings and beneath said stopper panel such that upon slided movement of said loading platform from covering relation above a first one of said access openings, beneath said stopper panel, and into covering relation atop a second one of said access openings, said item to be purchased on said loading platform will contact said stopper panel and slide off of said loading platform into said bag beneath said first one of said access openings, said loading platform alternately sliding from atop said first one of said access openings and said second one of said access openings.

21. To be used to checkout an item to be purchased, a purchase checkout station comprising:

product scanning means structured and disposed to scan a bar code of the item to be purchased and obtain pricing and purchase information relative to the item to be purchased, a data input connection disposed in information receiving and transmitting communication with said product scanning means, said data input connection structured and disposed to receive the pricing and purchase information relative to the items to be purchased from said product scanning means, data processing means structured and disposed to store and total the pricing and purchase information of all of the items to be purchased, display means structured and disposed to display the pricing and purchase information regarding the items to be purchased and the pricing totals regarding all of the items to be purchased to a user, a primary support surface, a loading platform movably disposed on said primary support surface and structured to receive each of the items to be purchased individually thereon, automatic bagging means structured and disposed to position an empty bag in an open position such that it will receive the item to be purchased on said loading platform therein only if said item to be purchased has been properly scanned by said product scanning means, said automatic bagging means being further structured to enable only a predetermined quantity of said items to be purchased to be disposed in said bag, wherein said primary support surface includes an access opening, said access opening being structured and disposed to overlie said bag of said automatic bagging means and allow access thereto by said items to be purchased, wherein said loading platform is disposed above said access opening such that upon movement of said loading platform out of covering relation above said access opening, said item to be purchased on said loading platform will fall off said loading platform into said bag beneath said access opening, wherein said loading platform has an upper face and wherein said product scanning means is mounted in said loading platform upper face such that placing said item to be purchased onto said loading platform both causes said item to be scanned and positions said item to fall from said loading platform into said bag upon said movement of said loading platform, and wherein two of said automatic bagging means are disposed to alternately receive said items to be purchased from said loading platform until said predetermined quantity of said items to be purchased is disposed in the bag of each of said automatic bagging means.

22. A purchase checkout station as recited in claim 21, wherein said primary support surface includes a pair of spaced access openings, each of said access openings being structured and disposed to overly said bag of each of said automatic bagging means and allow access thereto by said items to be purchased.

23. A purchase checkout station as recited in claim 21 wherein each of said automatic bagging means includes:

a bag reserve structured and disposed to contain a plurality of empty bags, automatic dispensing means structured to position one of said empty bags from the bag reserve to said open, item receiving position beneath said primary support surface, and removal means structured and disposed to move a full one of the bags from beneath said loading platform to a dispensing position.

* * * * *